US008870045B1

(12) United States Patent
Aguirre

(10) Patent No.: US 8,870,045 B1
(45) Date of Patent: Oct. 28, 2014

(54) MODULAR BACK PACK SYSTEM

(71) Applicant: Eliezer Aguirre, Tucson, AZ (US)

(72) Inventor: Eliezer Aguirre, Tucson, AZ (US)

( * ) Notice: Subject to any disclaimer, the term of this patent is extended or adjusted under 35 U.S.C. 154(b) by 89 days.

(21) Appl. No.: 13/790,159

(22) Filed: Mar. 8, 2013

(51) Int. Cl.
*A45F 3/04* (2006.01)
*A45F 4/02* (2006.01)

(52) U.S. Cl.
CPC ..... *A45F 4/02* (2013.01)
USPC ..... 224/651; 224/655; 224/581; 224/582; 224/583

(58) Field of Classification Search
USPC ..... 224/651, 581–583, 251, 250, 627, 224/645–647, 649, 637, 148.2, 148.4
See application file for complete search history.

(56) References Cited

U.S. PATENT DOCUMENTS 4,884,731 A * 12/1989 Sibley ..... 224/651
5,114,059 A * 5/1992 Thatcher ..... 224/148.5
5,544,792 A * 8/1996 Arnwine ..... 224/153
5,628,443 A * 5/1997 Deutsch ..... 224/583
5,961,017 A * 10/1999 Mehler ..... 224/576
6,290,114 B1 * 9/2001 Berberian ..... 224/642
7,654,426 B2 2/2010 Eberle
7,681,769 B2 * 3/2010 Kramer ..... 224/581
7,735,701 B2 6/2010 Eberle
2005/0061844 A1 * 3/2005 Haro ..... 224/639
2005/0184112 A1 * 8/2005 Copich ..... 224/148.2
2011/0186611 A1 * 8/2011 Eberle ..... 224/583
2012/0292353 A1 * 11/2012 Andersen ..... 224/149
2013/0264161 A1 * 10/2013 Thompson ..... 190/103

* cited by examiner

*Primary Examiner* — Adam Waggenspack

(57) ABSTRACT

The present invention features a modular back pack system having a bag with a zippered bag cover located on a bag top. A first adjustable shoulder strap and a second adjustable shoulder strap are located on a bag front. A bottom waist support is located on the bag front close to a bag bottom. The system features attachment straps and a water pouch with a water bag having a drinking hose. The system features a bag extension located in the bag having a flexible channel located around a bag top periphery. A gun pouch is located in the bag bottom. The system features a quiver, a sleeping bag and chair pouch, and a sleeping mat that attaches to the modular back pack system.

2 Claims, 7 Drawing Sheets

MODULAR BACK PACK SYSTEM

FIELD OF THE INVENTION

The present invention relates to luggage, or more specifically, back packs.

BACKGROUND OF THE INVENTION

A back pack in ancient times was used to carry a hunter's game and other materials. The bag itself was made up of different animal hide and skin that was sewn together. Soldiers and traveling workers have used varying forms of back packs through the centuries in a similar manner that students or hikers may commonly use them today. The present invention features a modular back pack system for use in carrying gear.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a modular back pack system for use in carrying gear when walking. In some embodiments, the system comprises a bag having a zippered bag cover located on a bag top. In some embodiments, a first adjustable shoulder strap and a second adjustable shoulder strap are located on a bag front. In some embodiments, a bottom waist support is located on the bag front close to a bag bottom.

In some embodiments, the system comprises an upper first side extension strap located on the bag cover close to a bag first side. In some embodiments, the system comprises an upper second side extension strap located on the bag cover close to a bag second side. In some embodiments, the system comprises a first top strap located on the first adjustable shoulder strap close to the bag top. In some embodiments, the system comprises a second top strap located on the second adjustable shoulder strap close to the bag top. In some embodiments, the system comprises a lower first side extension strap located in a first side pouch on the bag first side close to the bag bottom. In some embodiments, the system comprises a lower second side extension strap located in a second side pouch on the bag second side close to the bag bottom.

In some embodiments, the system comprises a water pouch having a water pouch top end removably located over the second side pouch. In some embodiments, the water pouch comprises a water bag having a drinking hose located thereon.

In some embodiments, the system comprises a first bottom strap located on the bag bottom close to the bag first side. In some embodiments, the system comprises a second bottom strap located on the bag bottom close to the bag second side. In some embodiments, the system comprises a first side middle strap located on the bag rear close to the bag first side and a second side middle strap is located on the bag rear close to the bag second side. In some embodiments, the system comprises a first side lower strap located on the bag rear close to the bag first side and a second side lower strap located on the bag rear close to the bag second side.

In some embodiments, the system comprises a bag extension located in the bag. In some embodiments, the bag extension comprises a flexible channel located around a bag top periphery having a first side bag extension strap located on the bag extension close to the bag first side and a second side bag extension strap located on the bag extension close to the bag second side.

In some embodiments, the system comprises a first side upper support strap located on the bag first side close to the bag top and the bag front and a second side upper support strap located on the bag first side close to the bag top and the bag rear. In some embodiments, the system comprises a first side lower support strap located on the bag first side close to the bag bottom and the bag front and a second side lower support strap located on the bag first side close to the bag bottom and the bag rear. In some embodiments, a gun pouch is located in the bag bottom.

In some embodiments, the system comprises a quiver having an upper quiver strap located on a quiver back close to a quiver top and a lower quiver strap located on a quiver bottom. In some embodiments, the quiver attaches to the modular back pack system via the upper quiver strap to the first top strap and the lower quiver strap to the first bottom strap.

In some embodiments, the system comprises a sleeping bag and chair pouch having an upper sleeping bag and chair pouch strap located on a sleeping bag and chair pouch back close to a sleeping bag and chair pouch top and a lower sleeping bag and chair strap located on a sleeping bag and chair pouch bottom. In some embodiments, the sleeping bag and chair pouch attaches to the modular back pack system via the upper sleeping bag and chair strap connecting to the second top strap and the lower sleeping bag and chair strap connecting to the second bottom strap.

DESCRIPTION OF PREFERRED EMBODIMENTS

Figure 1:
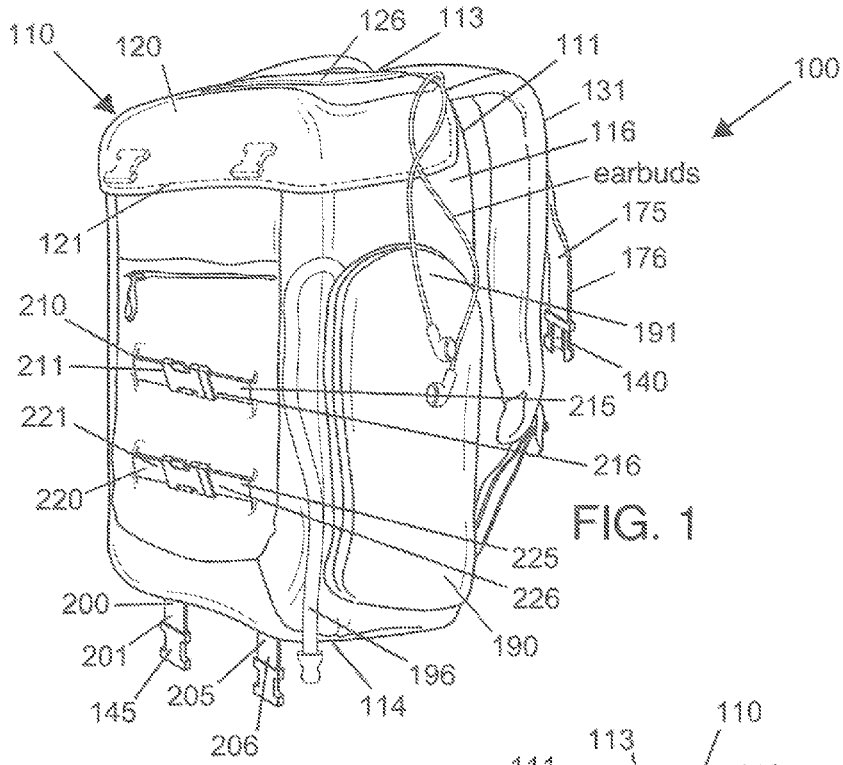
FIG. 1 shows a perspective view of the present invention.

Following is a list of elements corresponding to a particular element referred to herein:

100 Modular back pack system
110 Bag
111 Bag front
112 Bag rear
113 Bag top
114 Bag bottom
115 Bag first side
116 Bag second side
118 Bag aperture
120 Bag cover
121 Bag cover outer periphery

Figure 2:
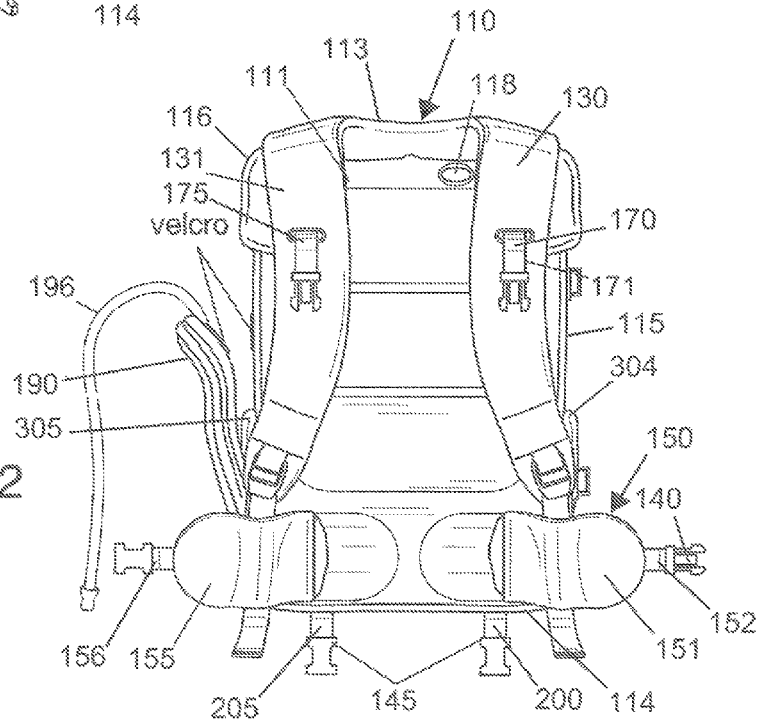
FIG. 2 shows a front view of the present invention.
Figure 3:
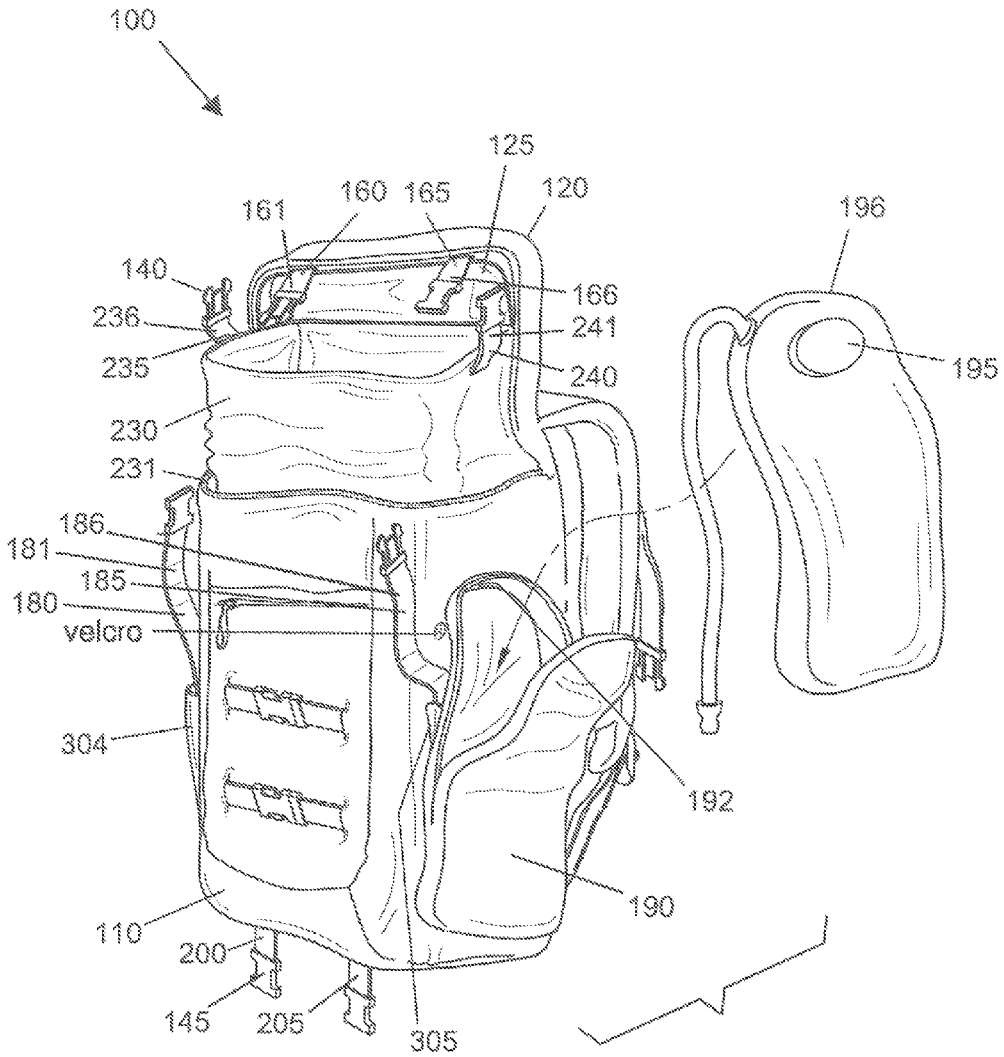
FIG. 3 shows a perspective view of the present invention featuring a bag extension.
Figure 4:
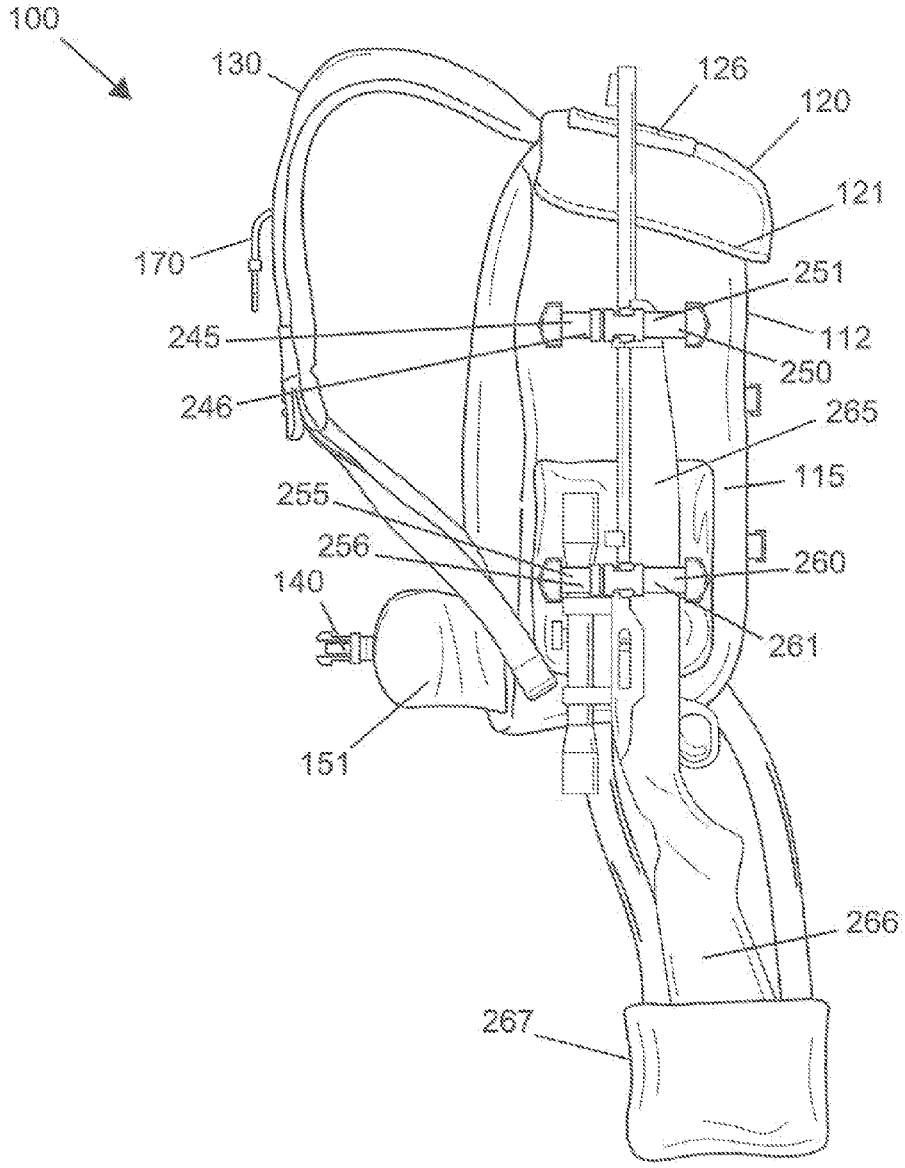
FIG. 4 shows a side view of the present invention featuring a gun pouch.
Figure 5:
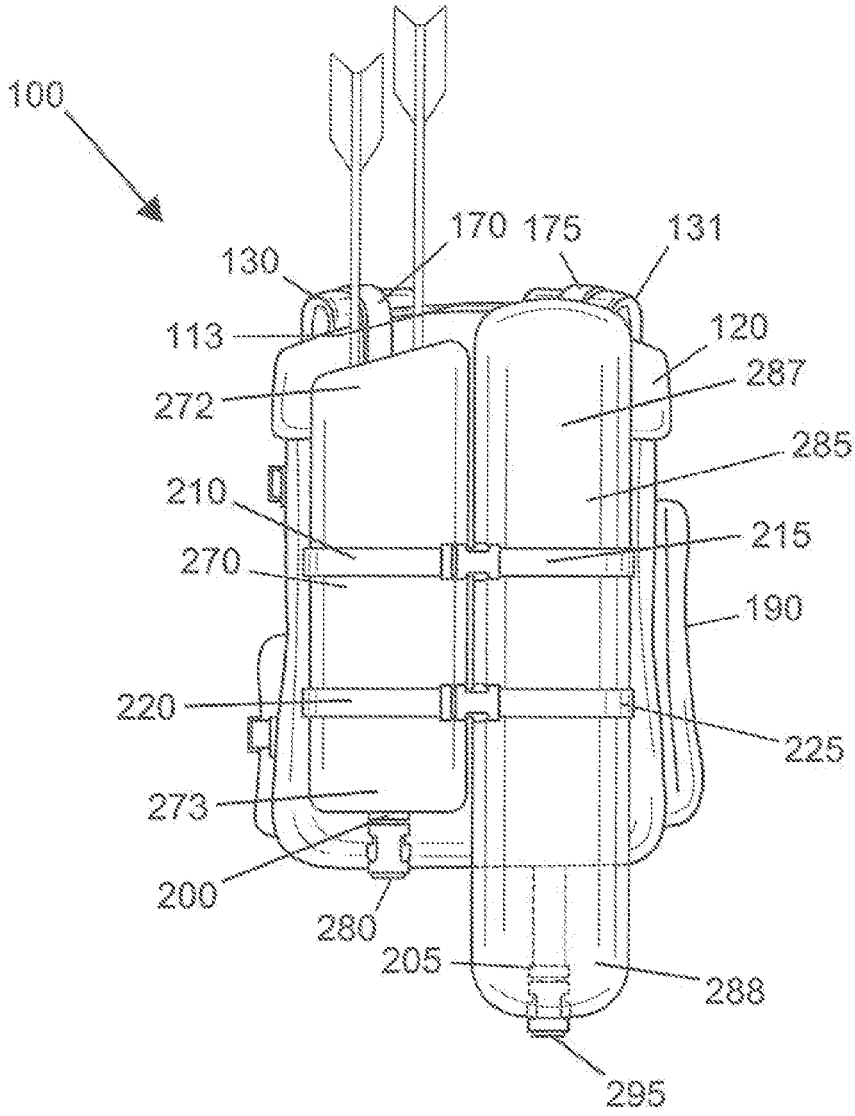
FIG. 5 shows a rear view of the present invention featuring a quiver and a sleeping bag and chair pouch, attached.
Figure 6:
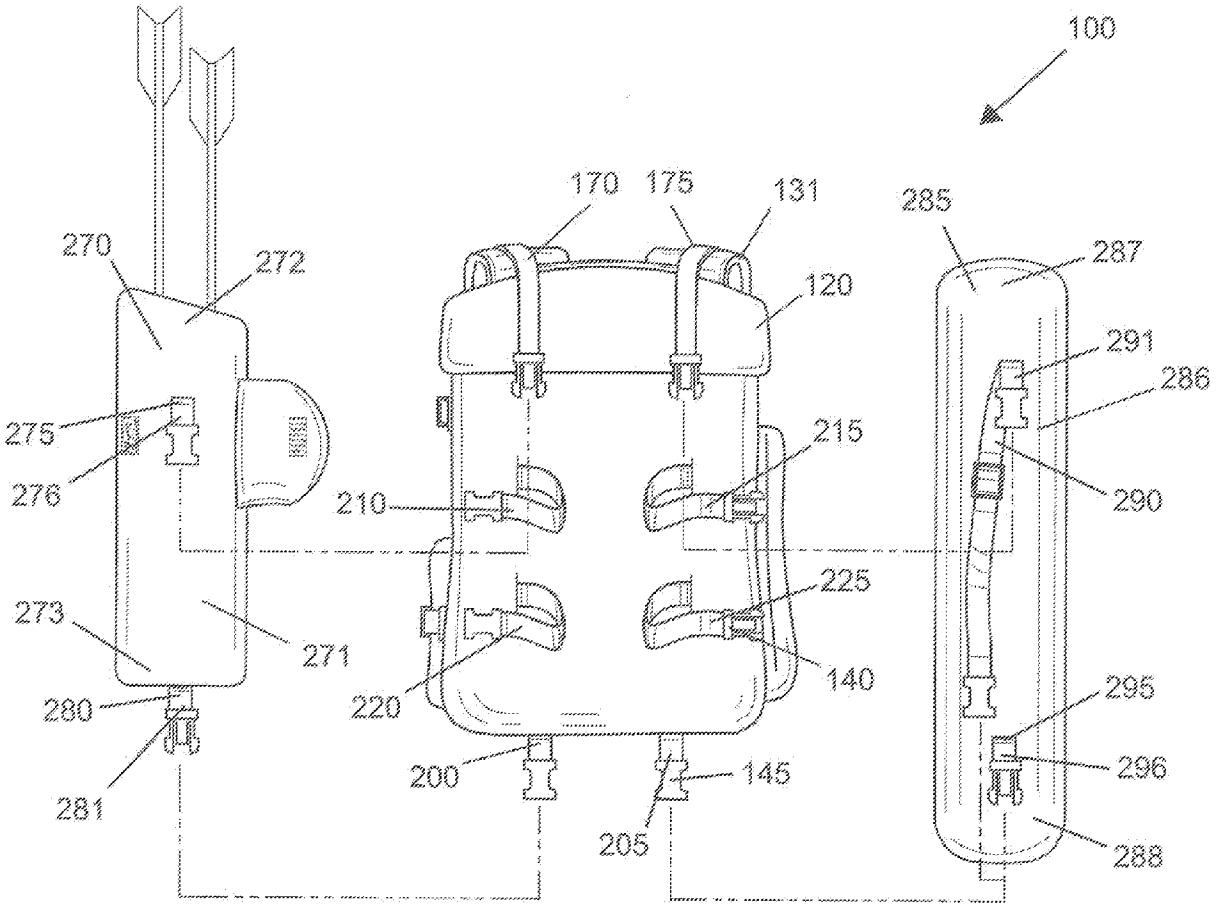
FIG. 6 shows a rear view of the present invention featuring a quiver and a sleeping bag and chair pouch, unattached.
Figure 7:
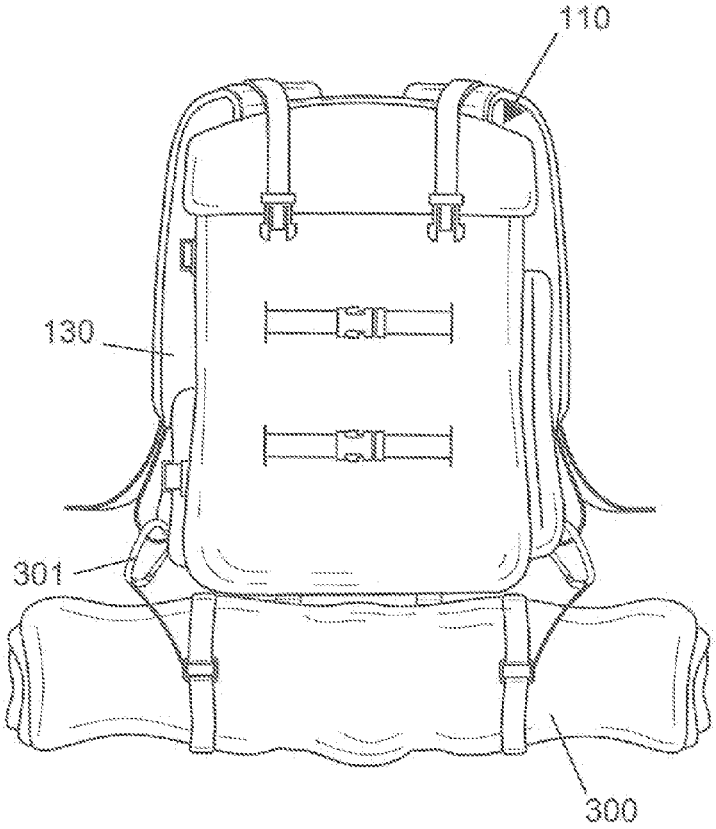
FIG. 7 shows a rear view of the present invention featuring a sleeping mat, attached.
Figure 8:
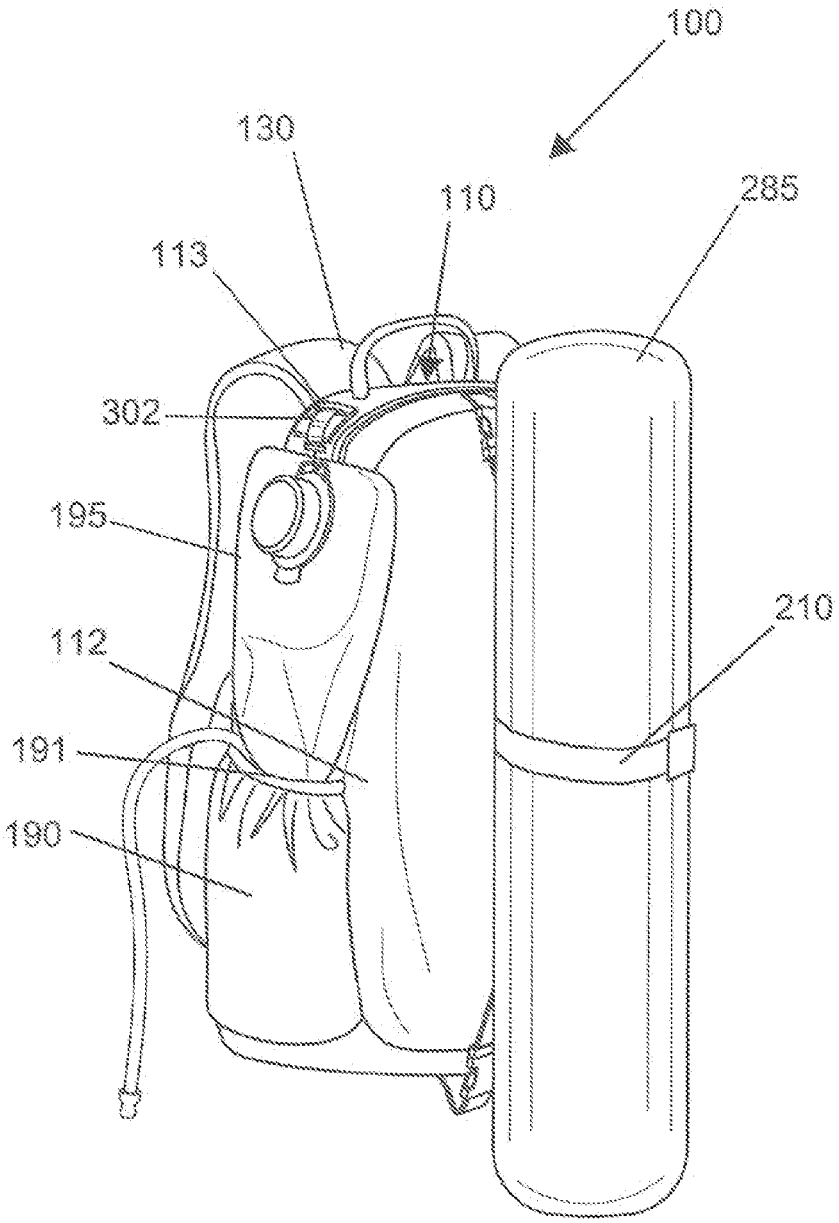
FIG. 8 shows a perspective view of an alternate embodiment of the present invention.

125 Skirt
126 Top pouch
130 First adjustable shoulder strap
131 Second adjustable shoulder strap
140 Male connector
145 Female connector
150 Bottom waist support
151 First side waist support strap
152 First side waist support strap free end
155 Second side waist support strap
156 Second side waist support strap free end
160 Upper first side extension strap
161 Upper first side extension strap free end
165 Upper second side extension strap
166 Upper second side extension strap free end
170 First top strap
171 First top strap free end
175 Second top strap
176 Second top strap free end
180 Lower first side extension strap
181 Lower first side extension strap free end
185 Lower second side extension strap
186 Lower second side extension strap free end
190 Water pouch
191 Water pouch top end
192 Water pouch aperture
195 Water bag
196 Drinking hose
200 First bottom strap
201 First bottom strap free end
205 Second bottom strap
206 Second bottom strap free end
210 First side middle strap
211 First side middle strap free end
215 Second side middle strap
216 Second side middle strap free end
220 First side lower strap
221 First side lower strap free end
225 Second side lower strap
226 Second side lower strap free end
230 Bag extension
231 Bag top periphery
235 First side bag extension strap
236 First side bag extension strap free end
240 Second side bag extension strap
241 Second side bag extension strap free end
245 First side upper support strap
246 First side upper support strap free end
250 Second side upper support strap
251 Second side upper support strap free end
255 First side lower support strap
256 First side lower support strap free end
260 Second side lower support strap
261 Second side lower support strap free end
265 Gun
266 Gun stock
267 Gun pouch
270 Quiver
271 Quiver back
272 Quiver top
273 Quiver bottom
275 Upper quiver strap
276 Upper quiver strap free end
280 Lower quiver strap
281 Lower quiver strap free end
285 Sleeping bag and chair pouch
286 Sleeping bag and chair pouch back
287 Sleeping bag and chair pouch top
288 Sleeping bag and chair pouch bottom
290 Upper sleeping bag and chair pouch strap
291 Upper sleeping bag and chair pouch strap free end
295 Lower sleeping bag and chair pouch strap
296 Lower sleeping bag and chair pouch strap free end
300 Sleeping mat
301 Clip
302 Hook
304 First side pouch
305 Second side pouch Referring now to FIG. 1-8, the present invention features a modular back pack system (100) for use in carrying gear when walking. In some embodiments, the system (100) comprises a bag (110) having a bag front (111), a bag rear (112), an open bag top (113), a bag bottom (114), a bag first side (115), and a bag second side (116). In some embodiments, the bag front (111) or the bag rear (112) comprises a bag aperture (118) located therein close to the bag top (113) for passage of ear buds or head phones. In some embodiments, the ear buds or head phones are attached to an audio device that is placed in the bag (110).

In some embodiments, a zippered bag cover (120) is located on the bag top (113). In some embodiments the bag cover (120) comprises a hinge located on an edge connected to the bag top (113). In some embodiments, the bag cover (120) comprises a skirt (125) located around a bag cover outer periphery (121) thereon to aid in covering contents of the bag (110) when overstuffed. In some embodiments, the bag cover (120) comprises a top pouch (126) located thereon.

In some embodiments, a first adjustable shoulder strap (130) is located on the bag front (111) close to the bag first side (115). In some embodiments, a second adjustable shoulder strap (131) is located on the bag front (111) close to the bag second side (116).

In some embodiments, a bottom waist support (150) is located on the bag front (111) close to the bag bottom (114). In some embodiments, the bottom waist support (150) comprises a padded first side waist support strap (151) having a male connector (140) located on a first side waist support strap free end (152) thereon. In some embodiments, the bottom waist support (150) comprises a padded second side waist support strap (155) having a female connector (145) located on a second side waist support strap free end (156) thereon.

In some embodiments, the bottom waist support (150) comprises a first vertical inside pocket disposed on an inside surface of the first side waist support strap (151). In some embodiments, the bottom waist support (150) comprises a second vertical inside pocket disposed on an inside surface of the second side waist support strap (155).

In some embodiments, the system (100) comprises an upper first side extension strap (160) located on the bag cover (120) close to the bag first side (115). In some embodiments, the upper first side extension strap (160) comprises a male connector (140) located on an upper first side extension strap free end (161) thereon. In some embodiments, the upper first side extension strap (160) can be hidden in a small pouch in the bag cover (120).

In some embodiments, the system (100) comprises an upper second side extension strap (165) located on the bag cover (120) close to the bag second side (116). In some embodiments, the upper second side extension strap (165) comprises a female connector (145) located on an upper second side extension strap free end (166) thereon. In some embodiments, the upper second side extension strap (165) can be hidden in a small pouch in the bag cover (120).

In some embodiments, the system (100) comprises a first top strap (170) located on the first adjustable shoulder strap (130) close to the bag top (113). In some embodiments, the first top strap (170) comprises a male connector (140) located on a first top strap free end (171) thereon.

In some embodiments, the system (100) comprises a second top strap (175) located on the second adjustable shoulder strap (131) close to the bag top (113). In some embodiments, the second top strap (175) comprises a male connector (140) located on a second top strap free end (176) thereon.

In some embodiments, the system (100) comprises a lower first side extension strap (180) located in a first side pouch (304) on the bag first side (115) close to the bag bottom (114). In some embodiments, the lower first side extension strap (180) comprises a female connector (145) located on a lower first side extension strap free end (181) thereon. In some embodiments the lower first side extension strap (180) connects to the upper first side extension strap (160).

In some embodiments, the system (100) comprises a lower second side extension strap (185) located in a second side pouch (305) on the bag second side (116) close to the bag bottom (114). In some embodiments, the lower second side extension strap (185) comprises a male connector (140) located on a lower second side extension strap free end (186) thereon. In some embodiments, the lower second side extension strap (185) connects to the upper second side extension strap (165).

In some embodiments, the system (100) comprises a water pouch (190) having a water pouch top end (191) removably located over the second side pouch (305) for access to the lower second side extension strap (185). In some embodiments, the water pouch (190) comprises a removable water bag (195) having a drinking hose (196) located thereon. In some embodiments, the water pouch (190) comprises a water pouch aperture (192) located therein for passage of the drinking hose (196) to a user.

In some embodiments, the system (100) comprises a first bottom strap (200) located on the bag bottom (114) close to the bag first side (115). In some embodiments, the first bottom strap (200) comprises a female connector (145) located on a first bottom strap free end (201) thereon.

In some embodiments, the system (100) comprises a second bottom strap (205) located on the bag bottom (114) close to the bag second side (116). In some embodiments, the second bottom strap (205) comprises a female connector (145) located on a second bottom strap free end (206) thereon.

In some embodiments, the system (100) comprises a first side middle strap (210) located on the bag rear (112) close to the bag first side (115). In some embodiments, the first side middle strap (210) comprises a female connector (145) located on a first side middle strap free end (211) thereon. In some embodiments, a second side middle strap (215) is located on the bag rear (112) close to the bag second side (116). In some embodiments, the second side middle strap (215) comprises a male connector (140) located on a second side middle strap free end (216) thereon. In some embodiments, the second side middle strap (215) is in line with and adapted to attachably interface with the first side middle strap (210).

In some embodiments, the system (100) comprises a plurality of first side middle straps (210) and second side middle straps (215). In some embodiments, the system (100) comprises 2 first side middle straps (210) and 2 second side middle straps (215). In some embodiments, the system (100) comprises 3 or more first side middle straps (210) and 3 or more second side middle straps (215).

In some embodiments, the system (100) comprises a first side lower strap (220) located on the bag rear (112) close to the bag first side (115). In some embodiments, the first side lower strap (220) comprises a female connector (145) located on a first side lower strap free end (221) thereon. In some embodiments, a second side lower strap (225) is located on the bag rear (112) close to the bag second side (116). In some embodiments, the second side lower strap (225) comprises a male connector (140) located on a second side lower strap free end (226) thereon. In some embodiments, the second side lower strap (225) is in line with and adapted to attachably interface with the first side lower strap (220). In some embodiments, the first side lower strap (220) and the second side lower strap (225) are located below the first side middle strap (210) and the second side middle strap (215).

In some embodiments, the system (100) comprises a bag extension (230) located in the bag (110). In some embodiments, the bag extension (230) comprises a flexible channel located around a bag top periphery (231). In some embodiments, the bag extension (230) comprises a first side bag extension strap (235) located on the bag extension (230) close to the bag first side (115). In some embodiments, the first side bag extension strap (235) comprises a male connector (140) located on an first side bag extension strap free end (236) thereon. In some embodiments, the bag extension (230) comprises a second side bag extension strap (240) located on the bag extension (230) close to the bag second side (116). In some embodiments, the second side bag extension strap (240) comprises a female connector (145) located on a second side bag extension strap free end (241) thereon. In some embodiments, the first side bag extension strap (235) connects to the lower first side extension strap (180). In some embodiments, the second side bag extension strap (240) connects to the lower second side extension strap (185).

In some embodiments, the system (100) comprises a first side upper support strap (245) located on the bag first side (115) close to the bag top (113) and the bag front (111). In some embodiments, the first side upper support strap (245) comprises a male connector (140) located on a first side upper support strap free end (246) thereon. In some embodiments, a second side upper support strap (250) is located on the bag first side (115) close to the bag top (113) and the bag rear (112). In some embodiments, the second side upper support strap (250) comprises a female connector (145) located on a second side upper support strap free end (251) thereon. In some embodiments, the second side upper support strap (250) is in line with and adapted to attachably interface with the first side upper support strap (245).

In some embodiments, the system (100) comprises a first side lower support strap (255) located on the bag first side (115) close to the bag bottom (114) and the bag front (111). In some embodiments, the first side lower support strap (255) comprises a male connector (140) located on a first side lower support strap free end (256) thereon. In some embodiments, a second side lower support strap (260) is located on the bag first side (115) close to the bag bottom (114) and the bag rear (112). In some embodiments, the second side lower support strap (260) comprises a female connector (145) located on a second side lower support strap free end (261) thereon. In some embodiments, the second side lower support strap (260) is in line with and adapted to attachably interface with the first side lower support strap (255). In some embodiments, the first side lower support strap (255) and the second side lower support strap (260) are located below the first side upper support strap (245) and the second side upper support strap (250).

In some embodiments, a gun pouch (267) is collapsibly located in the bag bottom (114). In some embodiments, the gun pouch (267) is located in a zippered storage pouch in the bag bottom (114) when not in use. In some embodiments, a gun stock (266) of a gun (265) is located in the gun pouch (267). In some embodiments, the first side upper support strap (245) attachably connects to the second side upper support strap (250) to secure the gun (265). In some embodiments, the first side lower support strap (255) attachably connects to the second side lower support strap (260) to secure the gun (265).

In some embodiments, the system (100) comprises a quiver (270) having an upper quiver strap (275) located on a quiver back (271) close to a quiver top (272) and a lower quiver strap (280) located on a quiver bottom (273). In some embodiments, the upper quiver strap (275) comprises a female connector (145) located on an upper quiver strap free end (276) thereon. In some embodiments, the lower quiver strap (280) comprises a male connector (140) located on a lower quiver strap free end (281) thereon. In some embodiments, the quiver (270) attaches to the modular back pack system (100) via the upper quiver strap (275) connecting to the first top strap (170) and the lower quiver strap (280) connecting to the first bottom strap (200).

In some embodiments, the system (100) comprises a sleeping bag and chair pouch (285) having an upper sleeping bag and chair pouch strap (290) located on a sleeping bag and chair pouch back (286) close to a sleeping bag and chair pouch top (287) and a lower sleeping bag and chair pouch strap (295) located on a sleeping bag and chair pouch bottom (288). In some embodiments, the upper sleeping bag and chair pouch strap (290) comprises a female connector (145) located on an upper sleeping bag and chair pouch strap free end (291) thereon. In some embodiments, the lower sleeping bag and chair pouch strap (295) comprises a male connector (140) located on a lower sleeping bag and chair pouch strap free end (296) thereon. In some embodiments, the sleeping bag and chair pouch (285) attaches to the modular back pack system (100) via the upper sleeping bag and chair pouch strap (290) attaching to the second top strap (175) and the lower sleeping bag and chair pouch strap (295) attaching to the second bottom strap (205).

In some embodiments, the first side middle strap (210) and the second side middle strap (215) are adapted to attach and wrap around the quiver (270) and or the sleeping bag and chair pouch (285) upon installation of the quiver (270) and tor the sleeping bag and chair pouch (285). In some embodiments, the first side lower strap (220) and the second side lower strap (225) are adapted to attach and wrap around the quiver (270) and/or the sleeping bag and chair pouch (285) upon installation of the quiver (270) and/or the sleeping bag and chair pouch (285).

In some embodiments, a sleeping mat (300) is attachably located on the bag bottom (114) via clips (301) removably located on the first adjustable shoulder strap (130) and the second adjustable shoulder strap (131).

Alternate Embodiment

Compact

In some embodiments, the system (100) is compact. In some embodiments, the water bag (195) is attachably located on an outside of the bag (110). In some embodiments, the water pouch (190) comprises an open water pouch top end (191). In some embodiments, a hook (302) is located on the bag top (113). In some embodiments, a handle is located on the bag top (113). In some embodiments, due to compact portions of system the rifle may be carried in a similar bag that the chair and sleeping bag are carried in, but only zippered.

In some embodiments, the system (100) comprises a first side middle strap (210) located on the bag rear (112) close to the bag first side (115). In some embodiments, the first side middle strap (210) comprises a female connector (145) located on a first side middle strap free end (211) thereon. In some embodiments, a second side middle strap (215) is located on the bag rear (112) close to the bag second side (116). In some embodiments, the second side middle strap (215) comprises a male connector (140) located on a second side middle strap free end (216) thereon. In some embodiments, the second side middle strap (215) is in line with and adapted to attachably interface with the first side middle strap (210).

In some embodiments, the system (100) comprises a sleeping bag and chair pouch (285) having an upper sleeping bag and chair pouch strap (290) located on a sleeping bag and chair pouch back (286) close to a sleeping bag and chair pouch top (287) and a lower sleeping bag and chair pouch strap (295) located on a sleeping bag and chair pouch bottom (288). In some embodiments, the upper sleeping bag and chair pouch strap (290) comprises a female connector (145) located on an upper sleeping bag and chair pouch strap free end (291) thereon. In some embodiments, the lower sleeping bag and chair pouch strap (295) comprises a male connector (140) located on a lower sleeping bag and chair pouch strap free end (296) thereon. In some embodiments, the sleeping bag and chair pouch (285) attaches to the modular back pack system (100) via the upper sleeping bag and chair pouch strap (290) attaching to the first top strap (170) and the lower sleeping bag and chair pouch strap (295) attaching to the first bottom strap (200). In some embodiments, the first top strap (170) is located on the bag rear (112) close to the bag top (113).

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety. In some embodiments, the present invention may comprise one or more of the features identified herein and in the claim 1 as presented below. For example, with respect to claim 1, the modular back pack system may broadly comprise any combination of features (or part of the features) identified in (a) through (q). In some embodiments, the modular back pack system may comprise three, or more or all of the features disclosed herein or features disclosed in claim 1 (a) through (q).

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way.

The reference numbers recited in the below claims are solely for ease of examination of this patent application, and are exemplary, and are not intended in any way to limit the scope of the claims to the particular features having the corresponding reference numbers in the drawings.

What is claimed is:

1. A modular back pack system (100) for use in carrying gear when walking, wherein the system (100) comprises:

(a) a bag (110) having a bag front (111), a bag rear (112), an open bag top (113), a bag bottom (114), a bag first side (115), and a bag second side (116), wherein the bag front (111) comprises a bag aperture (118) disposed therein proximal to the bag top (113) for passage of ear buds or head phones, wherein a zippered bag cover (120) is disposed on the bag top (113), wherein the bag cover (120) comprises a skirt (125) disposed around a bag cover outer periphery (121) thereon to aid in covering contents of the bag (110) when overstuffed, wherein the bag cover (120) comprises a top pouch (126) disposed thereon, wherein a first adjustable shoulder strap (130) is disposed on the bag front (111) proximal to the bag first side (115), wherein a second adjustable shoulder strap (131) is disposed on the bag front (111) proximal to the bag second side (116), wherein a bottom waist support (150) is disposed on the bag front (111) proximal to the bag bottom (114), wherein the bottom waist support (150) comprises a padded first side waist support strap (151) having a male connector (140) disposed on a first side waist support strap free end (152) thereon, wherein the bottom waist support (150) comprises a padded second side waist support strap (155) having a female connector (145) disposed on a second side waist support strap free end (156) thereon;

(b) an upper first side extension strap (160) disposed on the bag cover (120) proximal to the bag first side (115), wherein the upper first side extension strap (160) comprises a male connector (140) disposed on an upper first side extension strap free end (161) thereon;

(c) an upper second side extension strap (165) disposed on the bag cover (120) proximal to the bag second side (116), wherein the upper second side extension strap (165) comprises a female connector (145) disposed on an upper second side extension strap free end (166) thereon;

(d) a first top strap (170) disposed on the first adjustable shoulder strap (130) proximal to the bag top (113), wherein the first top strap (170) comprises a male connector (140) disposed on a first top strap free end (171) thereon;

(e) a second top strap (175) disposed on the second adjustable shoulder strap (131) proximal to the bag top (113), wherein the second top strap (175) comprises a male connector (140) disposed on a second top strap free end (176) thereon;

(f) a lower first side extension strap (180) disposed in a first side pouch (304) on the bag first side (115) proximal to the bag bottom (114), wherein the lower first side extension strap (180) comprises a female connector (145) disposed on a lower first side extension strap free end (181) thereon;

(g) a lower second side extension strap (185) disposed in a second side pouch (305) on the bag second side (116) proximal to the bag bottom (114), wherein the lower second side extension strap (185) comprises a male connector (140) disposed on a lower second side extension strap free end (186) thereon;

(h) a water pouch (190) having a water pouch top end (191) removably disposed over the second side pouch (305) for access to the lower second side extension strap (185), wherein the water pouch (190) comprises a water bag (195) having a drinking hose (196) disposed thereon, wherein the water pouch (190) comprises a water pouch aperture (192) disposed therein for passage of the drinking hose (196);

(i) a first bottom strap (200) disposed on the bag bottom (114) proximal to the bag first side (115), wherein the first bottom strap (200) comprises a female connector (145) disposed on a first bottom strap free end (201) thereon;

(j) a second bottom strap (205) disposed on the bag bottom (114) proximal to the bag second side (116), wherein the second bottom strap (205) comprises a female connector (145) disposed on a second bottom strap free end (206) thereon;

(k) a first side middle strap (210) disposed on the bag rear (112) proximal to the bag first side (115), wherein the first side middle strap (210) comprises a female connector (145) disposed on a first side middle strap free end (211) thereon, wherein a second side middle strap (215) is disposed on the bag rear (112) proximal to the bag second side (116), wherein the second side middle strap (215) comprises a male connector (140) disposed on a second side middle strap free end (216) thereon, wherein the second side middle strap (215) is in line with and adapted to attachably interface with the first side middle strap (210);

(l) a first side lower strap (220) disposed on the bag rear (112) proximal to the bag first side (115), wherein the first side lower strap (220) comprises a female connector (145) disposed on a first side lower strap free end (221) thereon, wherein a second side lower strap (225) is disposed on the bag rear (112) proximal to the bag second side (116), wherein the second side lower strap (225) comprises a male connector (140) disposed on a second side lower strap free end (226) thereon, wherein the second side lower strap (225) is in line with and adapted to attachably interface with the first side lower strap (220), wherein the first side lower strap (220) and the second side lower strap (225) are disposed below the first side middle strap (210) and the second side middle strap (215);

(m) a bag extension (230) disposed in the bag (110), wherein the bag extension (230) comprises a flexible channel disposed around a bag top periphery (231), wherein the bag extension (230) comprises a first side bag extension strap (235) disposed on the bag extension (230) proximal to the bag first side (115), wherein the first side bag extension strap (235) comprises a male connector (140) disposed on a first side bag extension strap free end (236) thereon, wherein the bag extension (230) comprises a second side bag extension strap (240) disposed on the bag extension (230) proximal to the bag second side (116), wherein the second side bag extension strap (240) comprises a female connector (145) disposed on a second side bag extension strap free end (241) thereon;

(n) a first side upper support strap (245) disposed on the bag first side (115) proximal to the bag top (113) and the bag front (111), wherein the first side upper support strap (245) comprises a male connector (140) disposed on a first side upper support strap free end (246) thereon, wherein a second side upper support strap (250) is disposed on the bag first side (115) proximal to the bag top (113) and the bag rear (112), wherein the second side upper support strap (250) comprises a female connector (145) disposed on a second side upper support strap free end (251) thereon, wherein the second side upper support strap (250) is in line with and adapted to attachably interface with the first side upper support strap (245);

(o) a first side lower support strap (255) disposed on the bag first side (115) proximal to the bag bottom (114) and the bag front (111), wherein the first side lower support strap (255) comprises a male connector (140) disposed on a first side lower support strap free end (256) thereon, wherein a second side lower support strap (260) is disposed on the bag first side (115) proximal to the bag bottom (114) and the bag rear (112), wherein the second side lower support strap (260) comprises a female connector (145) disposed on a second side lower support strap free end (261) thereon, wherein the second side lower support strap (260) is in line with and adapted to attachably interface with the first side lower support strap (255), wherein the first side lower support strap (255) and the second side lower support strap (260) are disposed below the first side upper support strap (245) and the second side upper support strap (250);

wherein a gun pouch (267) is collapsibly disposed in the bag bottom (114), wherein a gun stock (266) of a gun (265) is disposed in the gun pouch (267), wherein the first side upper support strap (245) attachably connects to the second side upper support strap (250) to secure the gun (265), wherein the first side lower support strap (255) attachably connects to the second side lower support strap (260) to secure the gun (265);

(p) a quiver (270) having an upper quiver strap (275) disposed on a quiver back (271) proximal to a quiver top (272) and a lower quiver strap (280) disposed on a quiver bottom (273), wherein the upper quiver strap (275) comprises a female connector (145) disposed on an upper quiver strap free end (276) thereon, wherein the lower quiver strap (280) comprises a male connector (140) disposed on a lower quiver strap free end (281) thereon, wherein the quiver (270) attaches to the modular back pack system (100) via the upper quiver strap (275) to the first top strap (170) and the lower quiver strap (280) to the first bottom strap (200); and (q) a sleeping bag and chair pouch (285) having an upper sleeping bag and chair pouch strap (290) disposed on a sleeping bag and chair pouch back (286) proximal to a sleeping bag and chair pouch top (287) and a lower sleeping bag and chair pouch strap (295) disposed on a sleeping bag and chair pouch bottom (288), wherein the upper sleeping bag and chair pouch strap (290) comprises a female connector (145) disposed on an upper sleeping bag and chair pouch strap free end (291) thereon, wherein the lower sleeping bag and chair pouch strap (295) comprises a male connector (140) disposed on a lower sleeping bag and chair pouch strap free end (296) thereon, wherein the sleeping bag and chair pouch (285) attaches to the modular back pack system (100) via the upper sleeping bag and chair pouch strap (290) attaching to the second top strap (175) and the lower sleeping bag and chair pouch strap (295) attaching to the second bottom strap (205);

wherein the first side middle strap (210) and the second side middle strap (215) are adapted to attach and wrap around the quiver (270) and the sleeping bag and chair pouch (285) upon installation of the quiver (270) and the sleeping bag and chair pouch (285), wherein the first side lower strap (220) and the second side lower strap (225) are adapted to attach and wrap around the quiver (270) and the sleeping bag and chair pouch (285) upon installation of the quiver (270) and the sleeping bag and chair pouch (285).

2. The system (100) of claim 1, wherein a sleeping mat (300) is attachably disposed on the bag bottom (114) via clips (301) removably disposed on the first adjustable shoulder strap (130) and the second adjustable shoulder strap (131).

* * * * *